US012584699B2

(12) United States Patent
Xu et al.

(10) Patent No.: US 12,584,699 B2
(45) Date of Patent: Mar. 24, 2026

(54) HEAT EXCHANGER AND AIR CONDITIONING SYSTEM HAVING SAME

(71) Applicant: Danfoss A/S, Nordborg (DK)

(72) Inventors: Jiaqi Xu, Haiyan (CN); Yanxing Li, Jiaxing (CN); Huan Jin, Jiaxing (CN); Yubao Liu, Jiaxing (CN); Jing Yang, Jiaxing (CN); Arturo Rios, Baltimore, MD (US)

(73) Assignee: DANFOSS A/S, Nordborg (DK)

( * ) Notice: Subject to any disclaimer, the term of this patent is extended or adjusted under 35 U.S.C. 154(b) by 184 days.

(21) Appl. No.: 18/541,864

(22) Filed: Dec. 15, 2023

(65) Prior Publication Data

US 2024/0200889 A1 Jun. 20, 2024

(30) Foreign Application Priority Data

Dec. 20, 2022 (CN) ..... 202211653961.3
Dec. 20, 2022 (CN) ..... 202223440729.X

(51) Int. Cl.
*F28D 7/06* (2006.01)
*F28F 9/02* (2006.01)

(52) U.S. Cl.
CPC ..... *F28F 9/0229* (2013.01)

(58) Field of Classification Search
CPC ..... F28F 9/0229
USPC ..... 165/176
See application file for complete search history.

(56) References Cited

U.S. PATENT DOCUMENTS 5,423,378 A * 6/1995 Dillenbeck ..... F28D 7/04 165/162
10,359,218 B2 * 7/2019 Byers ..... F25B 39/00

FOREIGN PATENT DOCUMENTS

CN 106642826 A 5/2017

* cited by examiner

*Primary Examiner* — Davis D Hwu
(74) *Attorney, Agent, or Firm* — McCormick, Paulding & Huber PLLC

(57) ABSTRACT

A heat exchanger and an air conditioning system having same, the heat exchanger including: a first manifold and a second manifold disposed at one and the same side of the heat exchanger; and multiple heat exchange tubes, each heat exchange tube including: two ends, the two ends respectively being a first end and a second end, the first end and second end being respectively connected to and in fluid communication with the first manifold and the second manifold; and multiple heat exchange parts, the multiple heat exchange parts including a first heat exchange part and a second heat exchange part, the first heat exchange part and second heat exchange part being respectively connected to and in fluid communication with the first end and the second end; in a lengthwise direction of the first manifold or second manifold, the ends of the multiple heat exchange tubes includes at least one pair of adjacently arranged first ends and/or at least one pair of adjacently arranged second ends. Heat exchange performance is thereby improved.

21 Claims, 15 Drawing Sheets

HEAT EXCHANGER AND AIR CONDITIONING SYSTEM HAVING SAME

CROSS-REFERENCE TO RELATED APPLICATIONS

This application claims foreign priority benefits under 35 U.S.C. § 119 from Chinese Patent Applications No. 202211653961.3, filed Dec. 20, 2022, and No. 202223440729.X, filed Dec. 20, 2022, the content of each of which is hereby incorporated by reference in its entirety.

TECHNICAL FIELD

The embodiments of the present invention relate to a heat exchanger and an air conditioning system having same.

BACKGROUND

In general, a heat exchanger such as a micro-channel heat exchanger comprises two manifolds, heat exchange tubes such as flat tubes connected between the two manifolds, and fins disposed between the heat exchange tubes.

SUMMARY

An objective of embodiments of the present invention is to provide a heat exchanger and an air conditioning system having same, so as to improve heat exchange performance.

Embodiments of the present invention provide a heat exchanger, comprising: a first manifold and a second manifold disposed at one and the same side of the heat exchanger; and multiple heat exchange tubes, each heat exchange tube comprising: two ends, the two ends respectively being a first end and a second end, the first end and the second end being respectively connected to and in fluid communication with the first manifold and the second manifold; and multiple heat exchange parts, the multiple heat exchange parts comprising a first heat exchange part and a second heat exchange part, the first heat exchange part and the second heat exchange part being respectively connected to and in fluid communication with the first end and the second end; in a lengthwise direction of the first manifold or the second manifold, the ends of the multiple heat exchange tubes comprising at least one pair of adjacently arranged first ends and/or at least one pair of adjacently arranged second ends.

According to an embodiment of the present invention, among the ends of the multiple heat exchange tubes, except for two outermost ends respectively located at two sides, the other ends comprise at least one pair of adjacently arranged first ends and/or at least one pair of adjacently arranged second ends.

According to an embodiment of the present invention, the heat exchange parts of the multiple heat exchange tubes are substantially parallel.

According to an embodiment of the present invention, each heat exchange tube further comprises a connecting part connecting multiple heat exchange parts.

According to an embodiment of the present invention, in the lengthwise direction of the first manifold or the second manifold, among the ends of the multiple heat exchange tubes, except for two outermost ends respectively located at two sides, the other ends comprise a first end group and a second end group arranged alternately, the first end group consisting of two first ends, and the second end group consisting of two second ends.

According to an embodiment of the present invention, in the lengthwise direction of the first manifold or the second manifold, among the ends of the multiple heat exchange tubes, except for two outermost ends respectively located at two sides, the other ends consist of a first end group and a second end group arranged alternately, the first end group consisting of two first ends, and the second end group consisting of two second ends.

According to an embodiment of the present invention, in the lengthwise direction of the first manifold or the second manifold, within a first range of the heat exchanger, the multiple heat exchange parts of each heat exchange tube further comprise a third heat exchange part and a fourth heat exchange part, which are respectively connected to the first heat exchange part and the second heat exchange part.

According to an embodiment of the present invention, in the lengthwise direction of the first manifold or the second manifold, within a second range of the heat exchanger which is different from the first range, the multiple heat exchange parts of each heat exchange tube consist of the first heat exchange part and the second heat exchange part.

According to an embodiment of the present invention, in the lengthwise direction of the first manifold or the second manifold, the number of heat exchange parts of each heat exchange tube within a first range of the heat exchanger is greater than the number of heat exchange parts of each heat exchange tube within a second range of the heat exchanger which is different from the first range.

According to an embodiment of the present invention, in the lengthwise direction of the first manifold or the second manifold, supposing that the number of heat exchange tubes within a first range of the heat exchanger is NL, and the number of heat exchange tubes within a second range of the heat exchanger which is different from the first range is NS, then $3*NS \leq 2*NL$.

According to an embodiment of the present invention, in the lengthwise direction of the first manifold or the second manifold, among the ends of the multiple heat exchange tubes, except for two outermost ends respectively located at two sides, the other ends comprise a first end and a second end arranged alternately within a first range of the heat exchanger, and a first end group and a second end group arranged alternately within a second range of the heat exchanger which is different from the first range, the first end group consisting of two first ends, and the second end group consisting of two second ends.

According to an embodiment of the present invention, the heat exchanger is configured such that during use, the wind speed of wind passing through the first range of the heat exchanger is greater than the wind speed of wind passing through the second range of the heat exchanger.

According to an embodiment of the present invention, in the lengthwise direction of the first manifold or the second manifold, the first range of the heat exchanger is a middle part of the heat exchanger, and the second range of the heat exchanger is parts at two sides of the first range of the heat exchanger.

According to an embodiment of the present invention, when viewed in a direction perpendicular to a plane in which the heat exchange parts of the heat exchange tubes lie, the heat exchanger has a triangular or trapezoidal shape.

According to an embodiment of the present invention, the heat exchanger is configured such that during use, the first manifold and the second manifold are arranged substantially horizontally.

According to an embodiment of the present invention, the heat exchanger further comprises: a fin, disposed between adjacent heat exchange parts.

According to an embodiment of the present invention, said one and the same side of the heat exchanger is one and the same side in the direction of extension of portions of the heat exchange parts, said portions being directly connected to the first end and the second end.

According to an embodiment of the present invention, each of the heat exchange tubes is a single-piece heat exchange tube.

According to an embodiment of the present invention, when viewed in the lengthwise direction of the first manifold or second manifold, the multiple heat exchange parts of each heat exchange tube substantially have a V-shape, an N-shape, an L-shape, or a shape formed by a non-closed line extending along a rectangle.

Embodiments of the present invention provide an air conditioning system, comprising the heat exchanger described above.

By using the heat exchanger and the air conditioning system having same according to embodiments of the present invention, heat exchange performance is improved.

DETAILED DESCRIPTION

Figure 1:
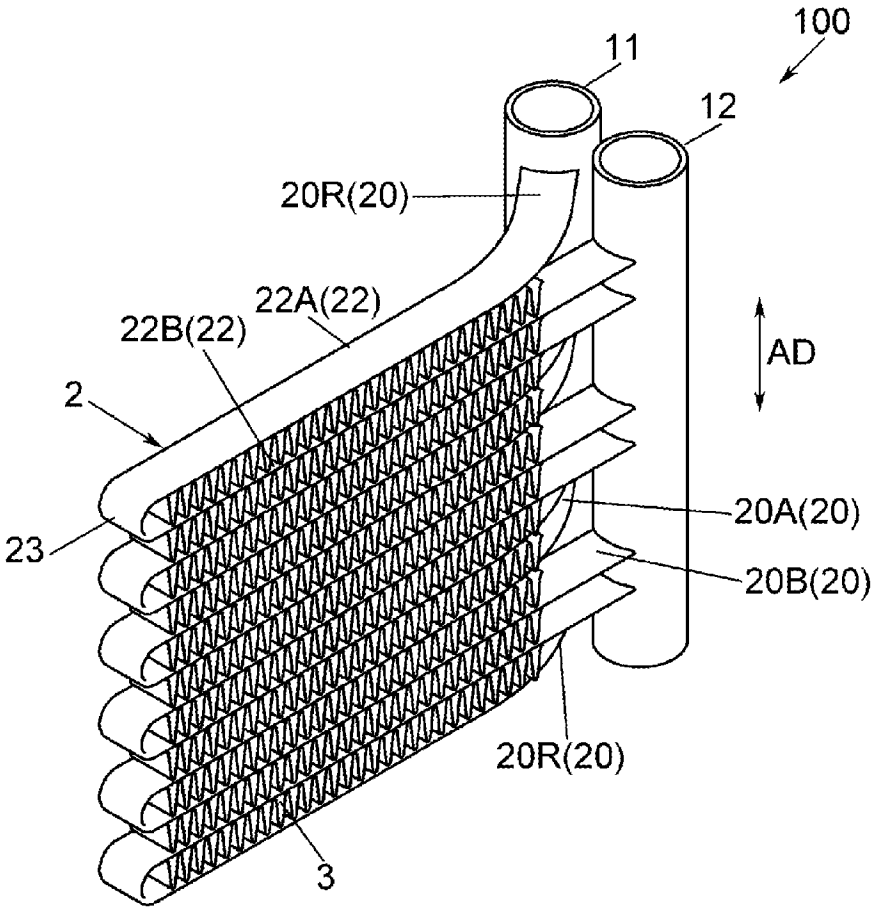
FIG. 1 is a schematic perspective view of a heat exchanger according to an embodiment of the present invention.

An air conditioning system according to embodiments of the present invention comprises a heat exchanger. Specifically, the air conditioning system according to embodiments of the present invention comprises a compressor, a heat exchanger serving as an evaporator, a heat exchanger serving as a condenser, and an expansion valve, etc.

As shown in FIGS. 1-15, a heat exchanger 100 such as a micro-channel heat exchanger according to embodiments of the present invention comprises: a first manifold 11 and a second manifold 12 disposed at one and the same side of the heat exchanger 100; and multiple heat exchange tubes 2 such as flat tubes. Each heat exchange tube 2 comprises: two ends 20, the two ends 20 being a first end 20A and a second end 20B respectively, the first end 20A and second end 20B being respectively connected to and in fluid communication with the first manifold 11 and the second manifold 12; and multiple heat exchange parts 22, the multiple heat exchange parts 22 comprising a first heat exchange part 22A and a second heat exchange part 22B, the first heat exchange part 22A and second heat exchange part 22B being respectively connected to and in fluid communication with the first end 20A and the second end 20B. In a lengthwise direction AD of the first manifold 11 or second manifold 12, the ends 20 of the multiple heat exchange tubes 2 comprise at least one pair of adjacently arranged first ends 20A and/or at least one pair of adjacently arranged second ends 20B. For example, among the ends 20 of the multiple heat exchange tubes 2, except for two outermost ends 20R respectively located at two sides (i.e. the top and bottom sides in FIGS. 1-11), the other ends 20 comprise at least one pair of adjacently arranged first ends 20A and/or at least one pair of adjacently arranged second ends 20B. No other ends 20 are between the adjacently arranged ends 20. Said one and the same side of the heat exchanger 100 may be one and the same side in the direction of extension of portions of the heat exchange parts 22, said portions being directly connected to the first end 20A and second end 20B. The heat exchanger 100 further comprises: fins 3, the fins 3 being disposed between adjacent heat exchange parts 22 or arranged alternately with the heat exchange parts 22.

According to some embodiments of the present invention, the heat exchange parts 22 may be straight tube segments. The heat exchange tubes 2 are arranged in the lengthwise direction AD of the first manifold 11 or second manifold 12. The heat exchange parts 22 of the multiple heat exchange tubes 2 may be substantially parallel, or adjacent heat exchange parts 22 may be substantially parallel.

According to some embodiments of the present invention, the first manifold 11 and second manifold 12 may be arranged substantially parallel, at a certain angle or side by side, or formed from a single tube by means of a longitudinal partition plate.

According to some embodiments of the present invention, referring to FIGS. 1-15, each heat exchange tube 2 further comprises a connecting part 23, which connects multiple heat exchange parts 22. The heat exchange tube 2 may be a single-piece heat exchange tube, and the connecting part 23 of the heat exchange tube 2 may be formed by bending. The connecting part 23 may also be a separate component, connecting the heat exchange parts 22 together by welding. The connecting part 23 may have a substantially U-like shape. The first end part 20A deviates from a centre line of the first heat exchange part 22A. The second end part 20B may also deviate from a centre line of the second heat exchange part 22B.

According to some embodiments of the present invention, referring to FIGS. 1-11, in the lengthwise direction AD of the first manifold 11 or second manifold 12, among the ends 20 of the multiple heat exchange tubes 2, except for the two outermost ends 20R respectively located at two sides, the other ends 20 comprise a first end group and a second end group arranged alternately, the first end group consisting of two first ends 20A, and the second end group consisting of two second ends 20B. In other words, the first end group consists of two adjacent first ends 20A, and the second end group consists of two adjacent second ends 20B. According to an example of the present invention, referring to FIGS. 1-7, in the lengthwise direction AD of the first manifold 11 or second manifold 12, among the ends 20 of the multiple heat exchange tubes 2, except for the two outermost ends 20R respectively located at two sides, the other ends 20 consist of a first end group and a second end group arranged alternately, the first end group consisting of two first ends 20A, and the second end group consisting of two second ends 20B.

In other words, the first end group consists of two adjacent first ends 20A, and the second end group consists of two adjacent second ends 20B.

Figure 6:
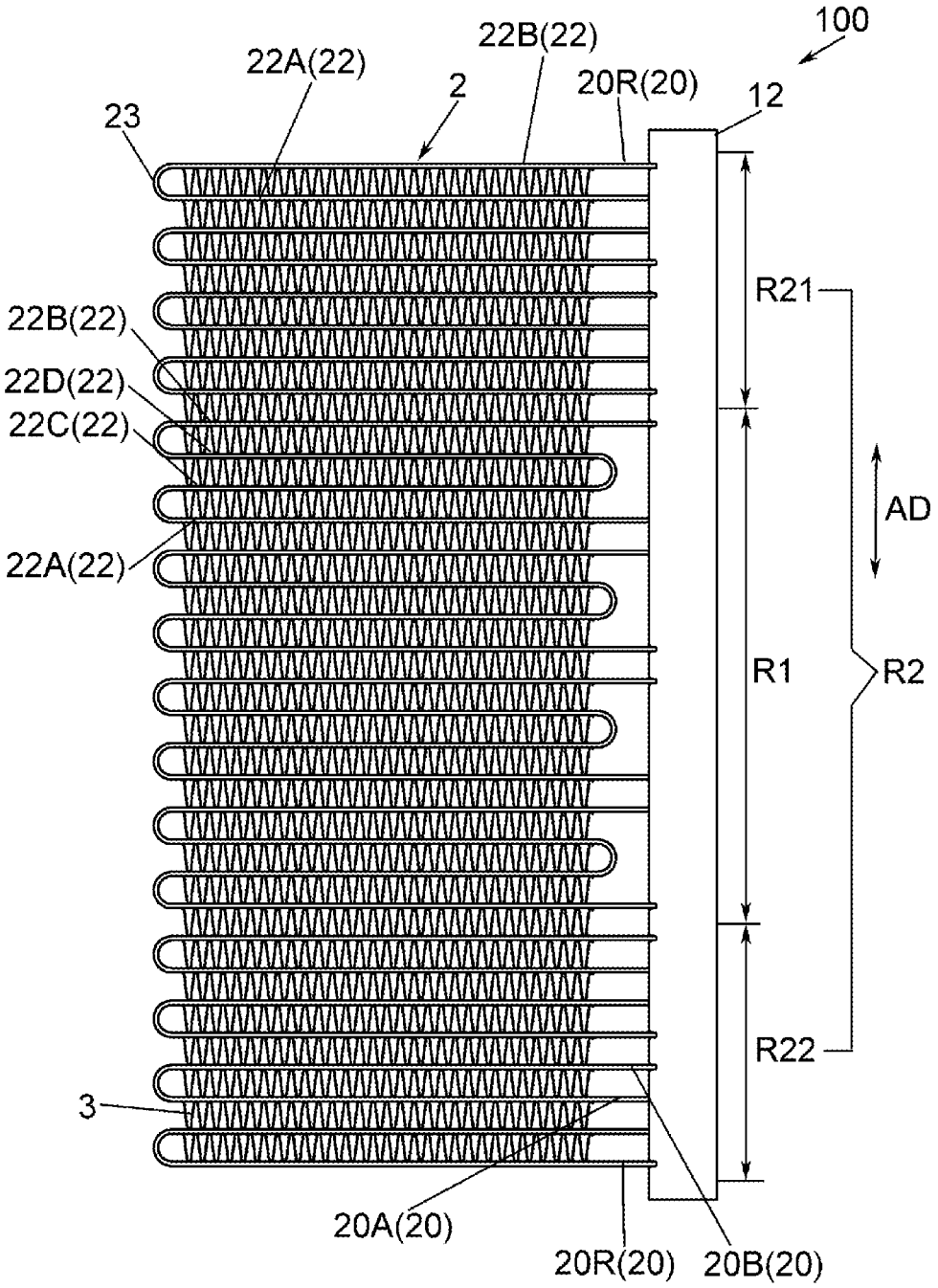
FIG. 6 is a schematic main view of the heat exchanger shown in FIG. 4.
Figure 7:
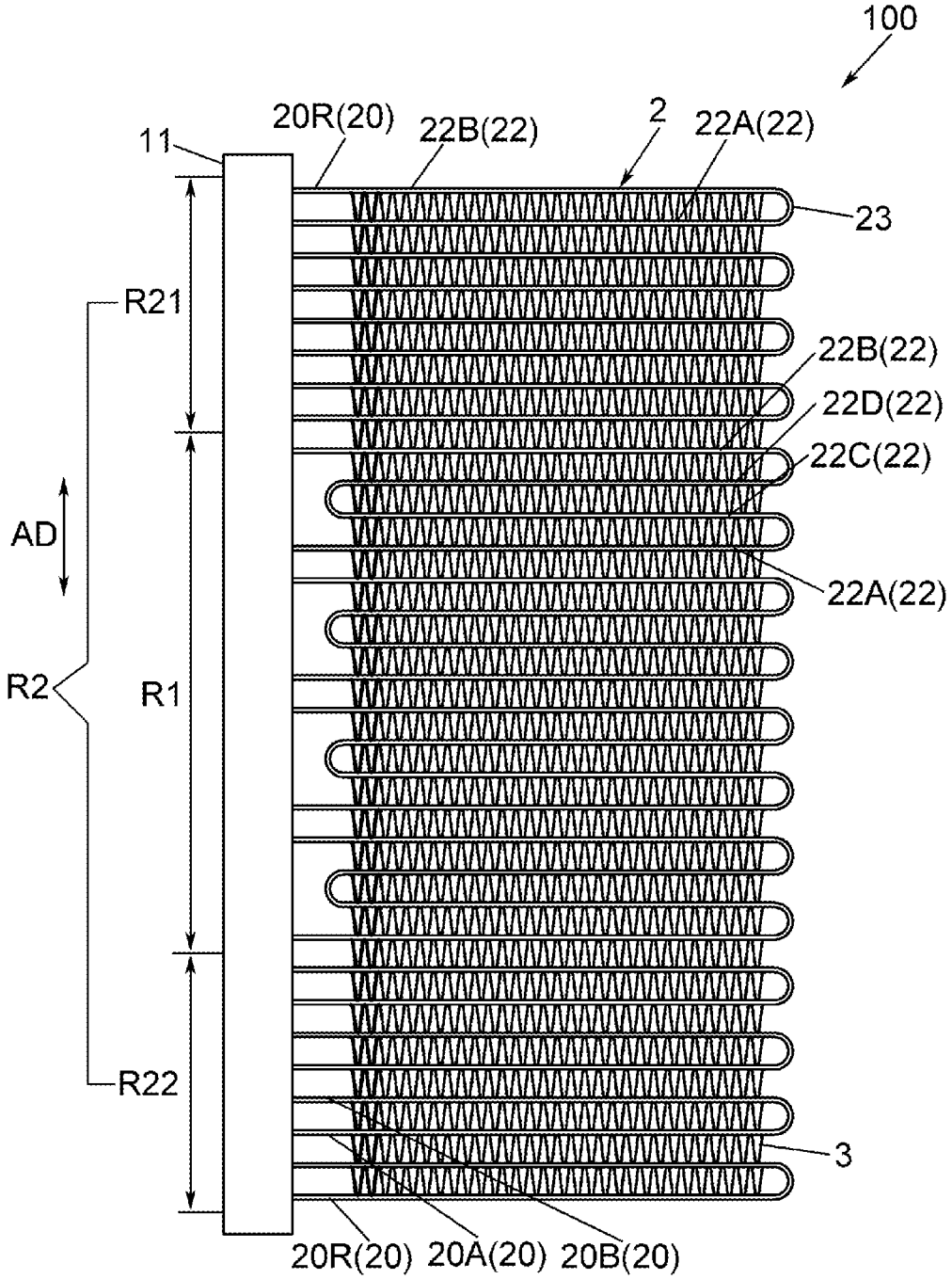
FIG. 7 is a schematic rear view of the heat exchanger shown in FIG. 4.
Figure 8:
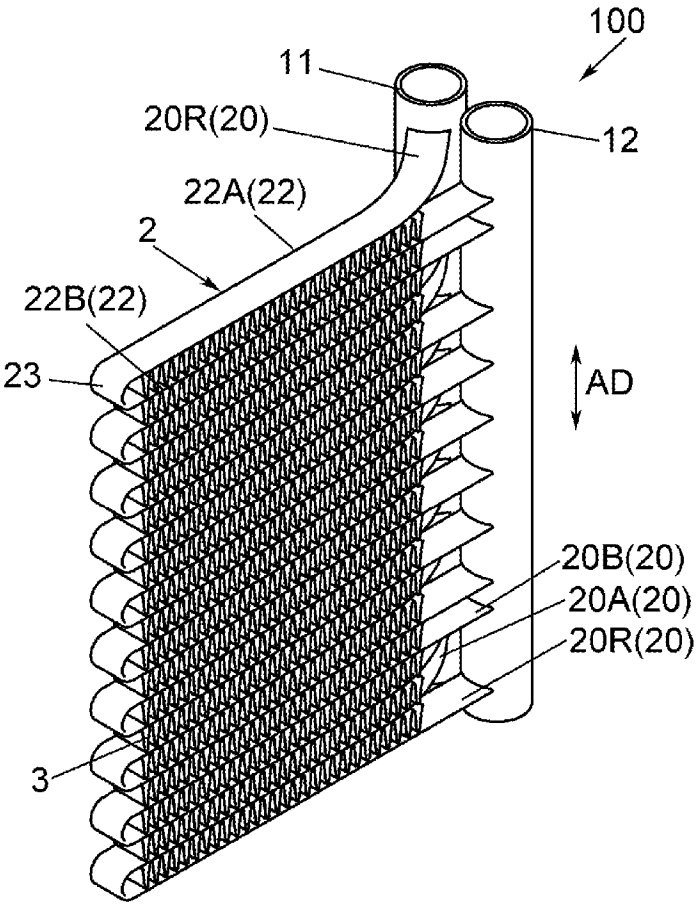
FIG. 8 is a schematic perspective view of a heat exchanger according to another embodiment of the present invention, viewed from one side.
Figure 9:
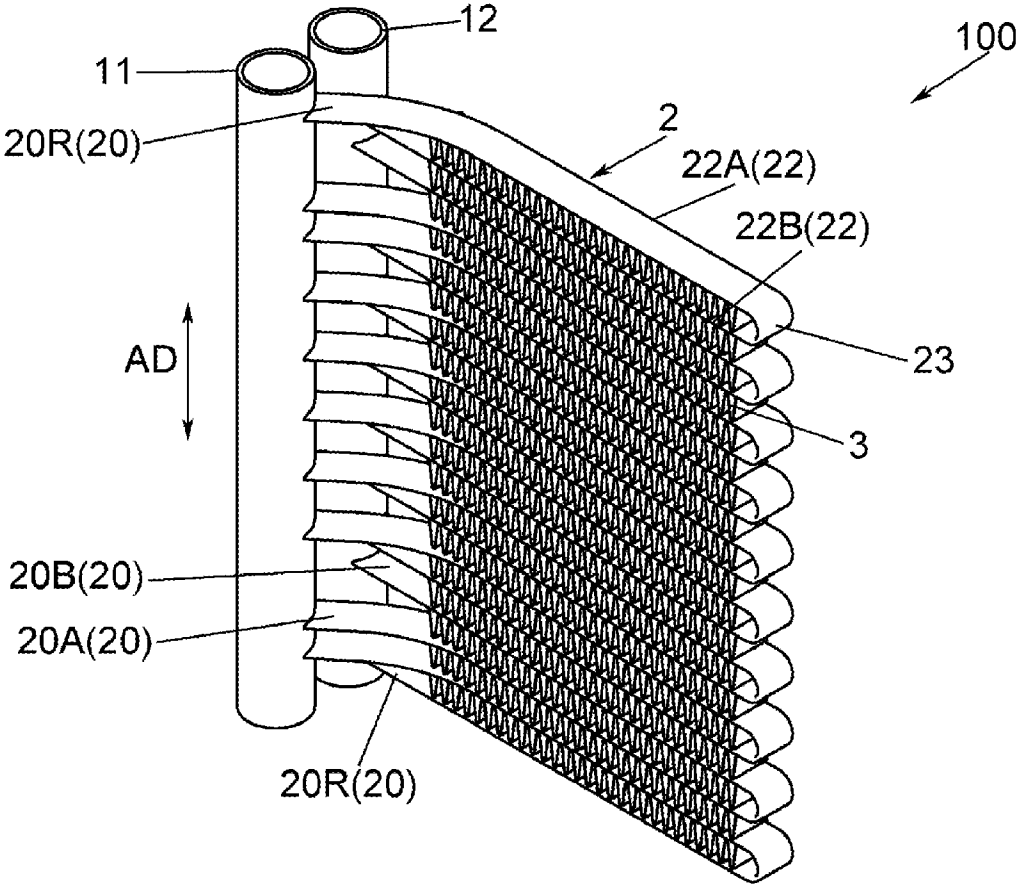
FIG. 9 is a schematic perspective view of the heat exchanger shown in FIG. 8, viewed from another side.

According to some embodiments of the present invention, referring to FIGS. 4-7, in the lengthwise direction AD of the first manifold 11 or second manifold 12, the number of heat exchange parts 22 of each heat exchange tube 2 within a first range R1 of the heat exchanger 100 is greater than the number of heat exchange parts 22 of each heat exchange tube 2 within a second range R2 of the heat exchanger 100 which is different from the first range R1. In FIGS. 6 and 7, the second range R2 consists of a range R21 and a range R22. For example, in the lengthwise direction AD of the first manifold 11 or second manifold 12, within the first range R1 of the heat exchanger 100, the multiple heat exchange parts 22 of each heat exchange tube 2 further comprise a third heat exchange part 22C and a fourth heat exchange part 22D, which are respectively connected to the first heat exchange part 22A and the second heat exchange part 22B. In the lengthwise direction AD of the first manifold 11 or second manifold 12, within the second range R2 of the heat exchanger 100 which is different from the first range R1, the multiple heat exchange parts 22 of each heat exchange tube 2 consist of the first heat exchange part 22A and the second heat exchange part 22B. For example, the number of heat exchange parts 22 of the heat exchange tube 2 may be 2, 4, 6, 8, 10 or more; and the numbers of heat exchange parts 22 of the two types of heat exchange tubes 2 may differ by 2, 4, 6, 8 or more. In addition, depending on the installation environment, the lengths of the heat exchange parts 22 of the two types of heat exchange tubes 2 may also be different. Alternatively, three, four or more types of heat exchange tubes 2 with different numbers of heat exchange parts 22 may be used.

According to some embodiments of the present invention, referring to FIGS. 4-7, in the lengthwise direction AD of the first manifold 11 or second manifold 12, suppose that the number of heat exchange tubes 2 within the first range R1 of the heat exchanger 100 is NL, and the number of heat exchange tubes 2 within the second range R2 of the heat exchanger 100 which is different from the first range R1 is NS, then $3*NS \leq 2*NL$.

Figure 10:
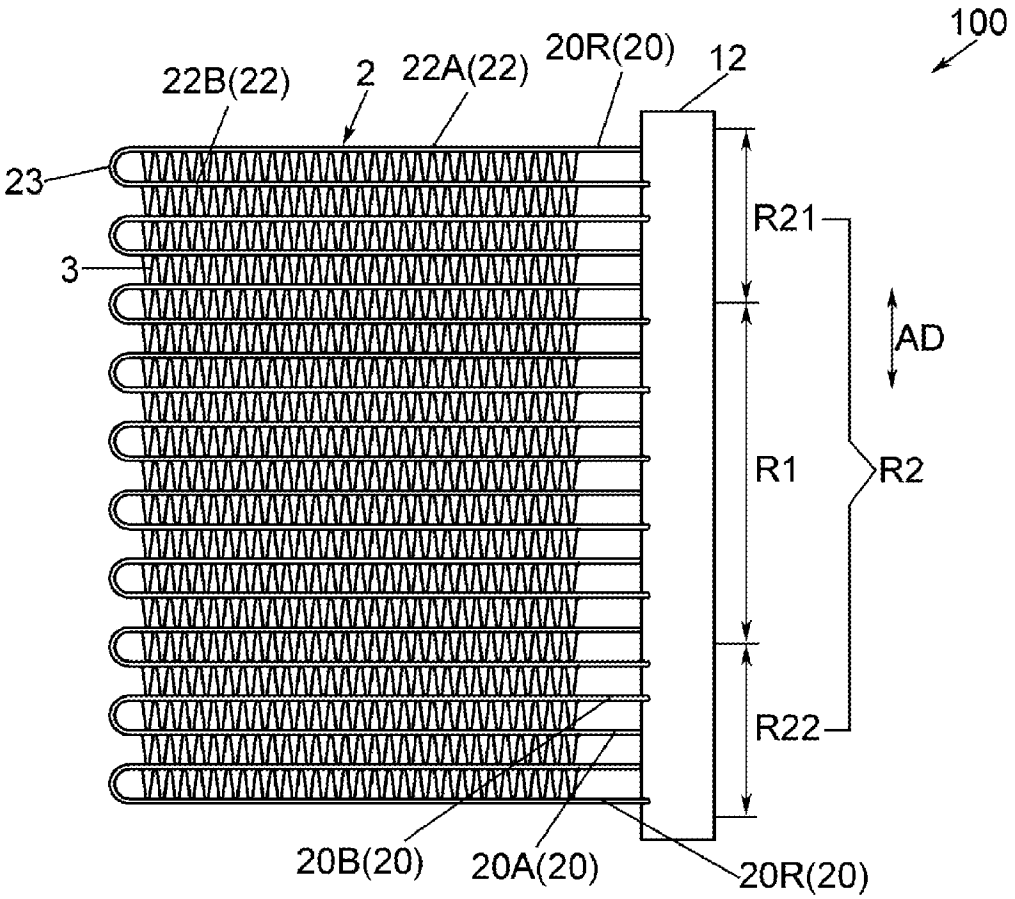
FIG. 10 is a schematic main view of the heat exchanger shown in FIG. 8.
Figure 11:
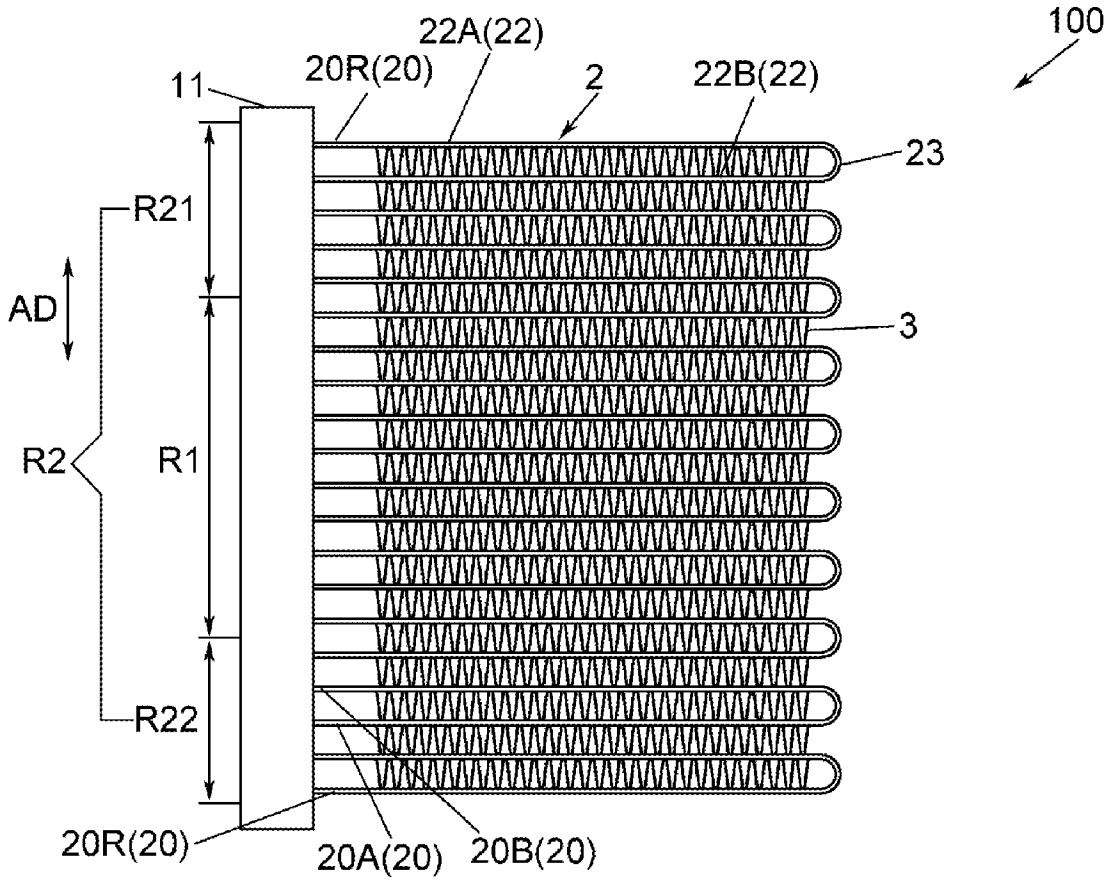
FIG. 11 is a schematic rear view of the heat exchanger shown in FIG. 8.
Figure 12:
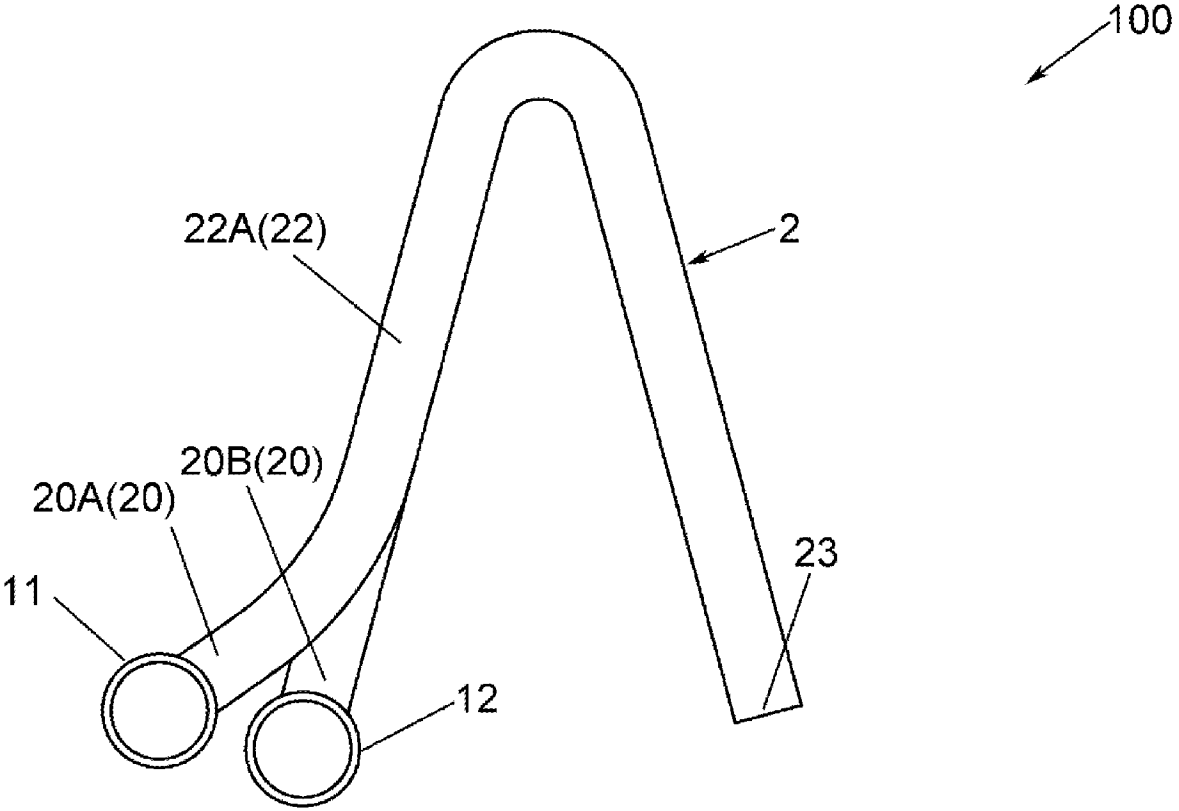
FIG. 12 is a schematic top view of a heat exchanger according to a variant example in embodiments of the present invention.
Figure 13:
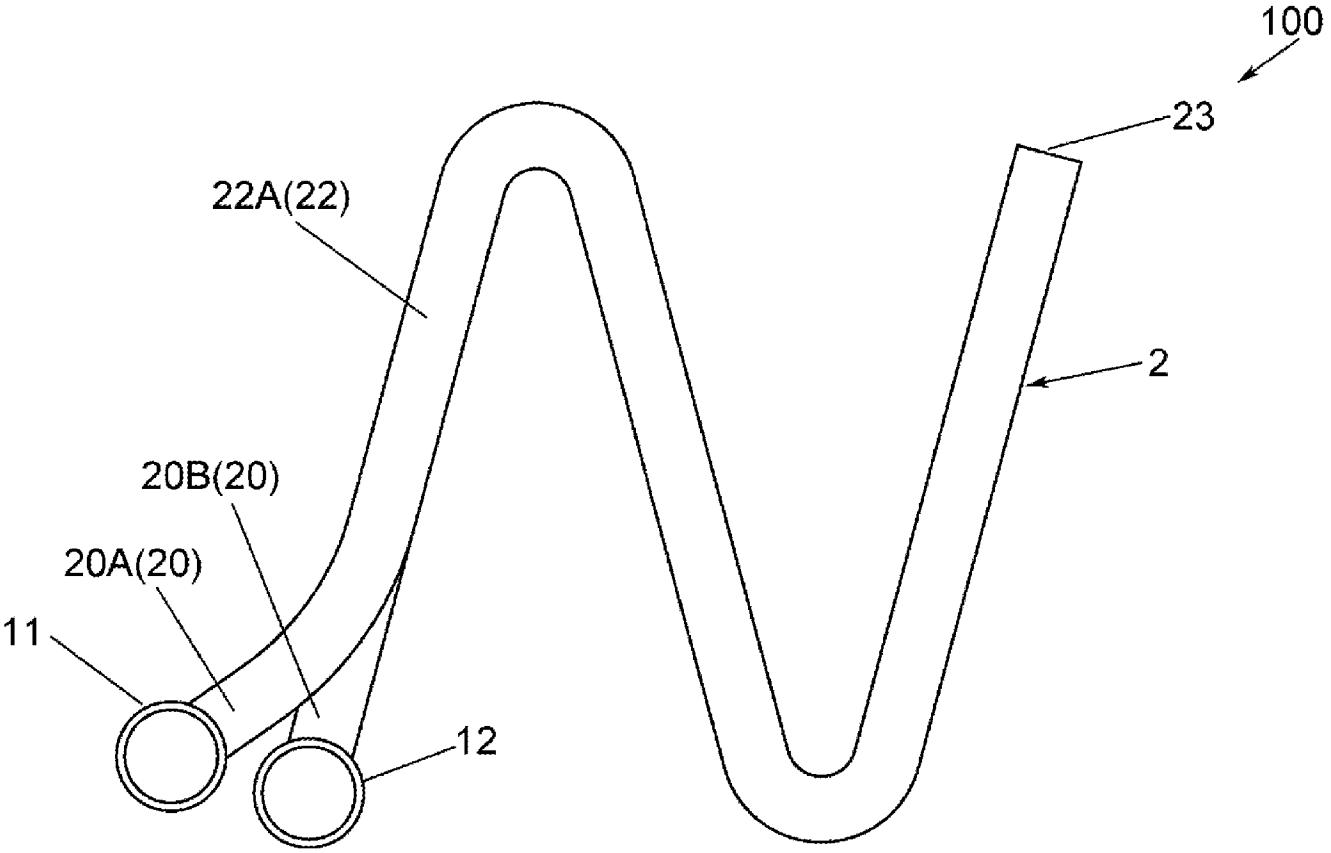
FIG. 13 is a schematic top view of a heat exchanger according to another variant example in embodiments of the present invention.
Figure 14:
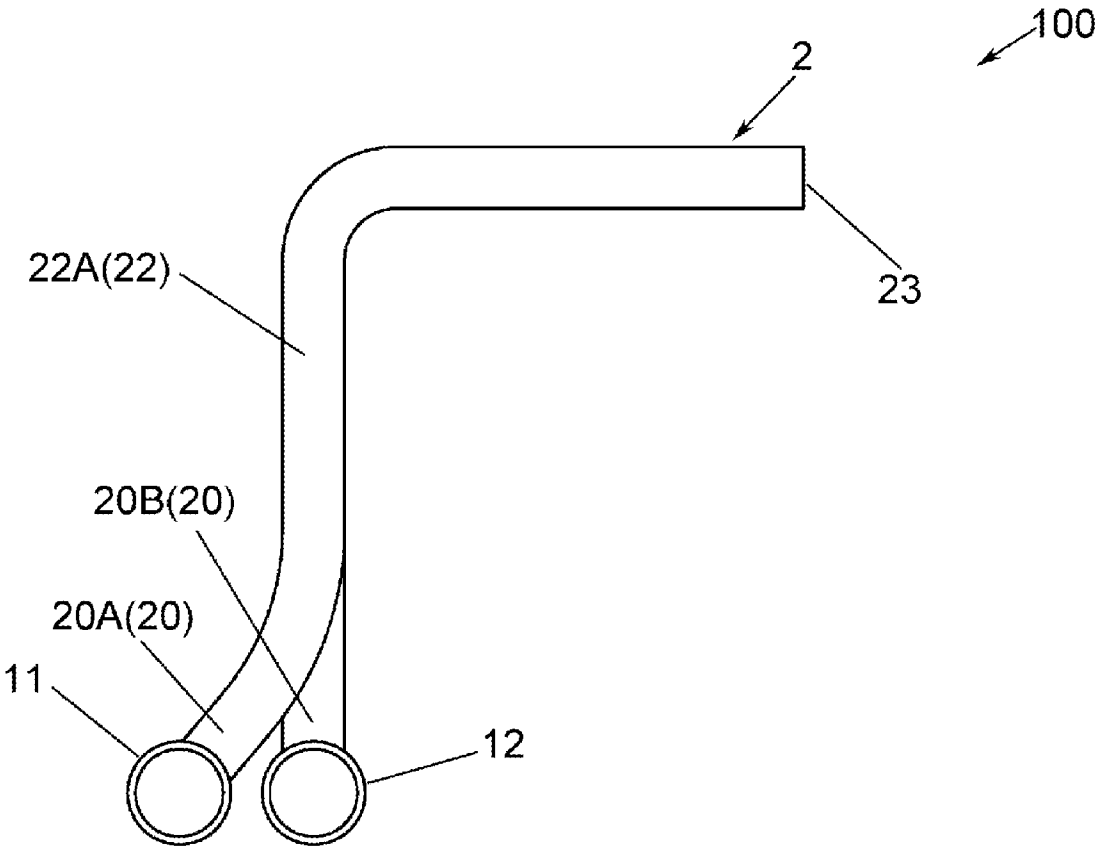
FIG. 14 is a schematic top view of a heat exchanger according to another variant example in embodiments of the present invention.
Figure 15:
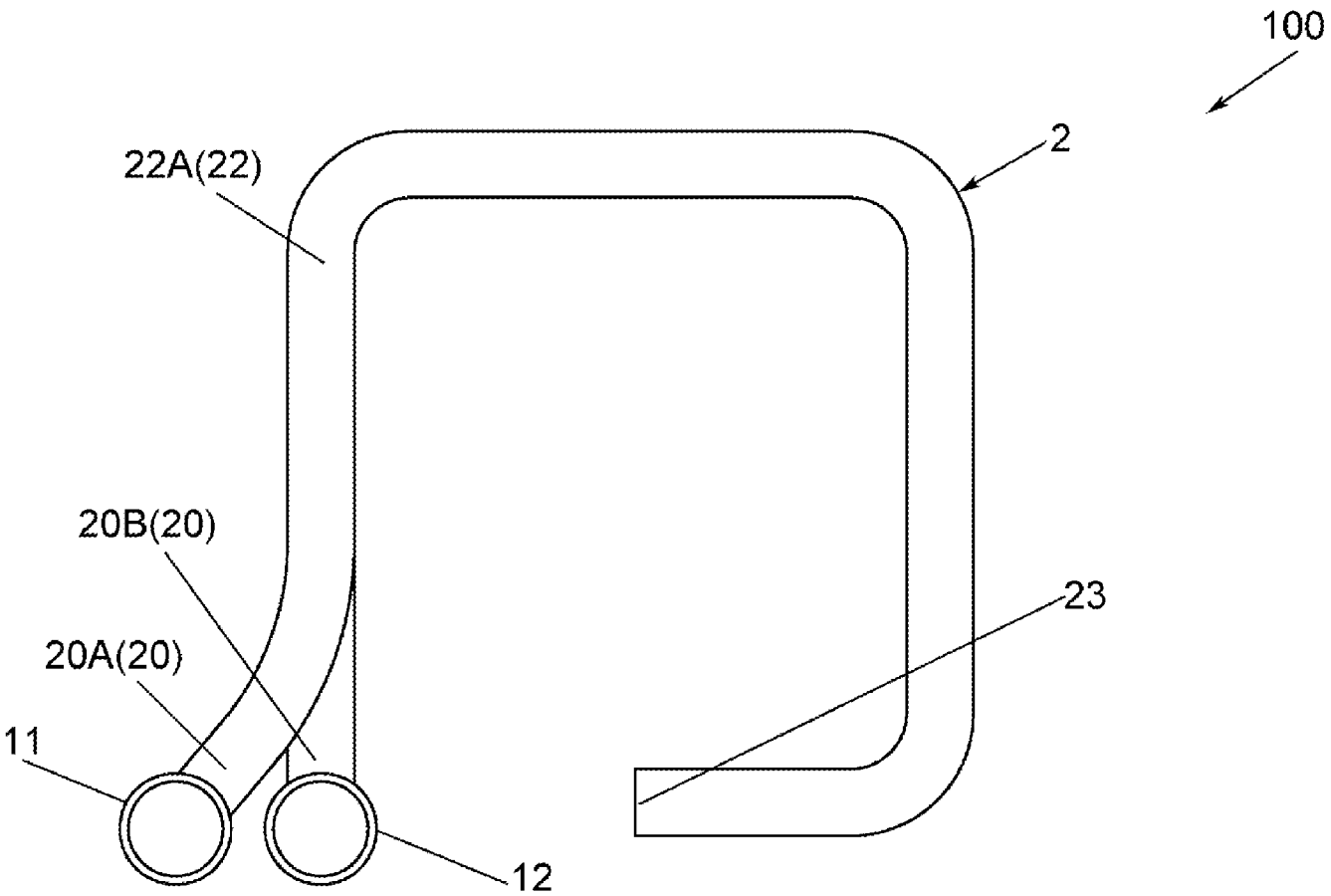
FIG. 15 is a schematic top view of a heat exchanger according to another variant example in embodiments of the present invention.

According to some embodiments of the present invention, referring to FIGS. 8-11, in the lengthwise direction AD of the first manifold 11 or second manifold 12, among the ends 20 of the multiple heat exchange tubes 2, except for the two outermost ends 20R respectively located at two sides, the other ends 20 comprise first ends 20A and second ends 20B arranged alternately within a first range R1 of the heat exchanger 100, and a first end group and a second end group arranged alternately within a second range R2 of the heat exchanger 100 which is different from the first range R1, the first end group consisting of two first ends 20A, and the second end group consisting of two second ends 20B. In other words, the first end group consists of two adjacent first ends 20A, and the second end group consists of two adjacent second ends 20B. In FIGS. 10 and 11, the second range R2 consists of a range R21 and a range R22.

According to some embodiments of the present invention, referring to FIGS. 8-11, suppose that the wind speed of wind passing through the heat exchanger 100 increases and then decreases in the lengthwise direction AD of the first manifold 11 or second manifold 12. In the lengthwise direction AD of the first manifold 11 or second manifold 12, within the second range R2 consisting of the ranges R21 and R22 at the two sides where the wind speed is lower, the first end group and second end group are arranged alternately, the first end group consisting of two first ends 20A, and the second end group consisting of two second ends 20B. In this way, a thermal bridge effect is reduced within the second range R2, so as to enhance a heat exchange effect. In a central region in the lengthwise direction AD of the first manifold 11 or second manifold 12, i.e. within the first range R1, the first ends 20A and second ends 20B are arranged alternately. Thus, although there will be a thermal bridge effect within the first range R1, the uniformity of temperature of the wind exiting the heat exchanger as a whole can be effectively increased.

According to some embodiments of the present invention, referring to FIGS. 4-11, the heat exchanger 100 is configured such that during use, the wind speed of wind passing through a first range R1 of the heat exchanger 100 is greater than the wind speed of wind passing through a second range R2 of the heat exchanger 100. For example, in the lengthwise direction AD of the first manifold 11 or second manifold 12, the first range R1 of the heat exchanger 100 is a middle part of the heat exchanger 100, and the second range R2 of the heat exchanger 100 is parts at two sides of the first range R1 of the heat exchanger 100, i.e. a range R21 and a range R22. In FIGS. 6, 7, 10 and 11, the second range R2 consists of the range R21 and the range R22.

Referring to FIGS. 4-7, in embodiments of the present invention, heat exchange tubes of different lengths, e.g. heat exchange tubes having different numbers of heat exchange parts 22 with each heat exchange part 22 having the same length, may be disposed in the lengthwise direction AD of the first manifold 11 or second manifold 12, according to the distribution of wind speeds of wind passing through the heat exchanger 100 in the lengthwise direction AD of the first manifold 11 or second manifold 12, so as to utilize the wind field rationally and increase the heat exchange efficiency. For example, the wind speed of wind passing through the heat exchanger 100 increases and then decreases in the lengthwise direction AD of the first manifold 11 or second manifold 12; according to the distribution of wind speeds of the wind, heat exchange tubes of different lengths, e.g. heat exchange tubes having different numbers of heat exchange parts 22 with each heat exchange part 22 having the same length, are disposed in the lengthwise direction AD of the first manifold 11 or second manifold 12, so as to enhance the heat exchange effect. The total length of the heat exchange tube 2 is the sum of the lengths of the two ends 20, the multiple heat exchange parts 22 and the connecting part 23. In this example, referring to FIGS. 6 and 7, in the lengthwise direction AD of the first manifold 11 or second manifold 12, the wind speed of the wind at the two sides (the top and bottom sides in FIGS. 4-7) is lower; therefore, N1 and N3 shorter heat exchange tubes 2, i.e. heat exchange tubes 2 with fewer heat exchange parts 22, are respectively disposed at the two sides, i.e. in the second range R2 formed by range R21 and range R22. The wind speed of the wind in the middle region is higher; therefore, N2 longer heat exchange tubes 2, i.e. heat exchange tubes 2 with more heat exchange parts 22, are disposed in the middle region, i.e. in the first range R1, and 3(N1+N3)≤2*N2. It must be explained that although the two types of heat exchange tubes 2 respectively comprise 2 heat exchange parts 22 and 4 heat exchange parts 22 in the embodiments shown in FIGS. 4-7, the two types of heat exchange tubes 2 may respectively comprise any number of heat exchange parts 22. For example, the number of heat exchange parts 22 of the heat exchange tube 2 may be 2, 4, 6, 8, 10 or more; and the numbers of heat exchange parts 22 of the two types of heat exchange tubes 2 may differ by 2, 4, 6, 8 or more. In addition, depending on the installation environment, the lengths of the heat exchange parts 22 of the two types of heat exchange tubes 2 may also be different. Alternatively, three, four or more types of heat exchange tubes 2 with different numbers of heat exchange parts 22 may be used.

Figure 2:
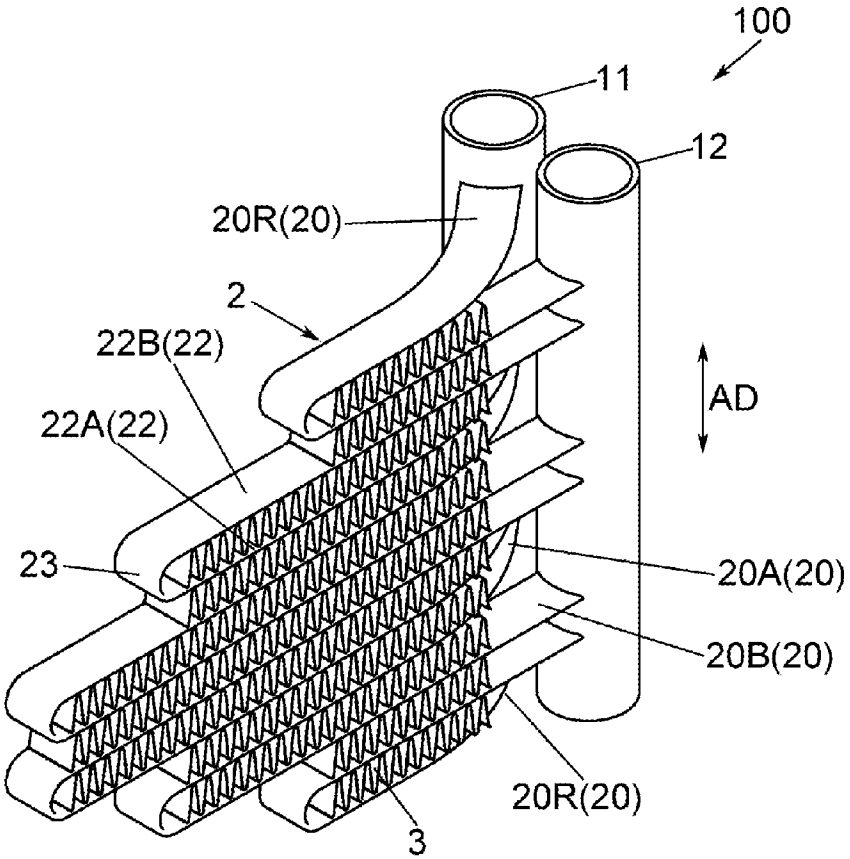
FIG. 2 is a schematic perspective view of a heat exchanger according to another embodiment of the present invention.
Figure 3:
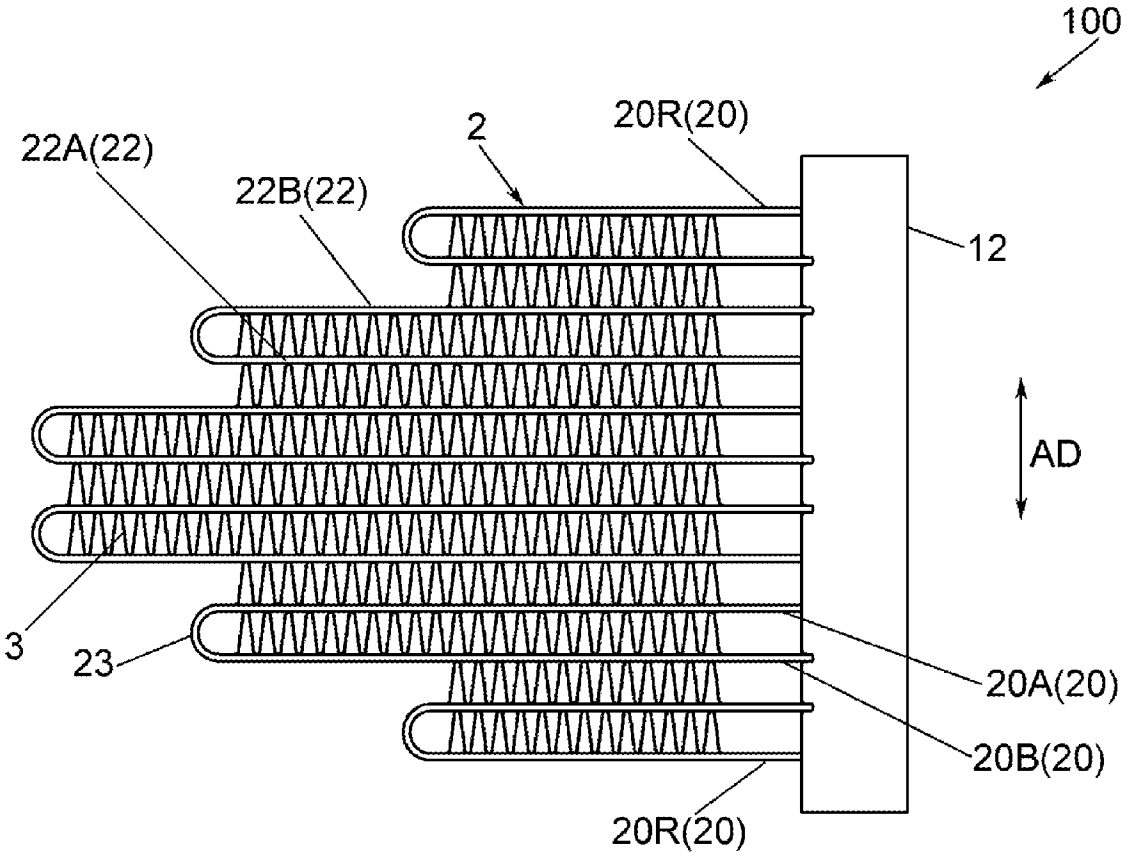
FIG. 3 is a main view of the heat exchanger shown in FIG. 2.
Figure 4:
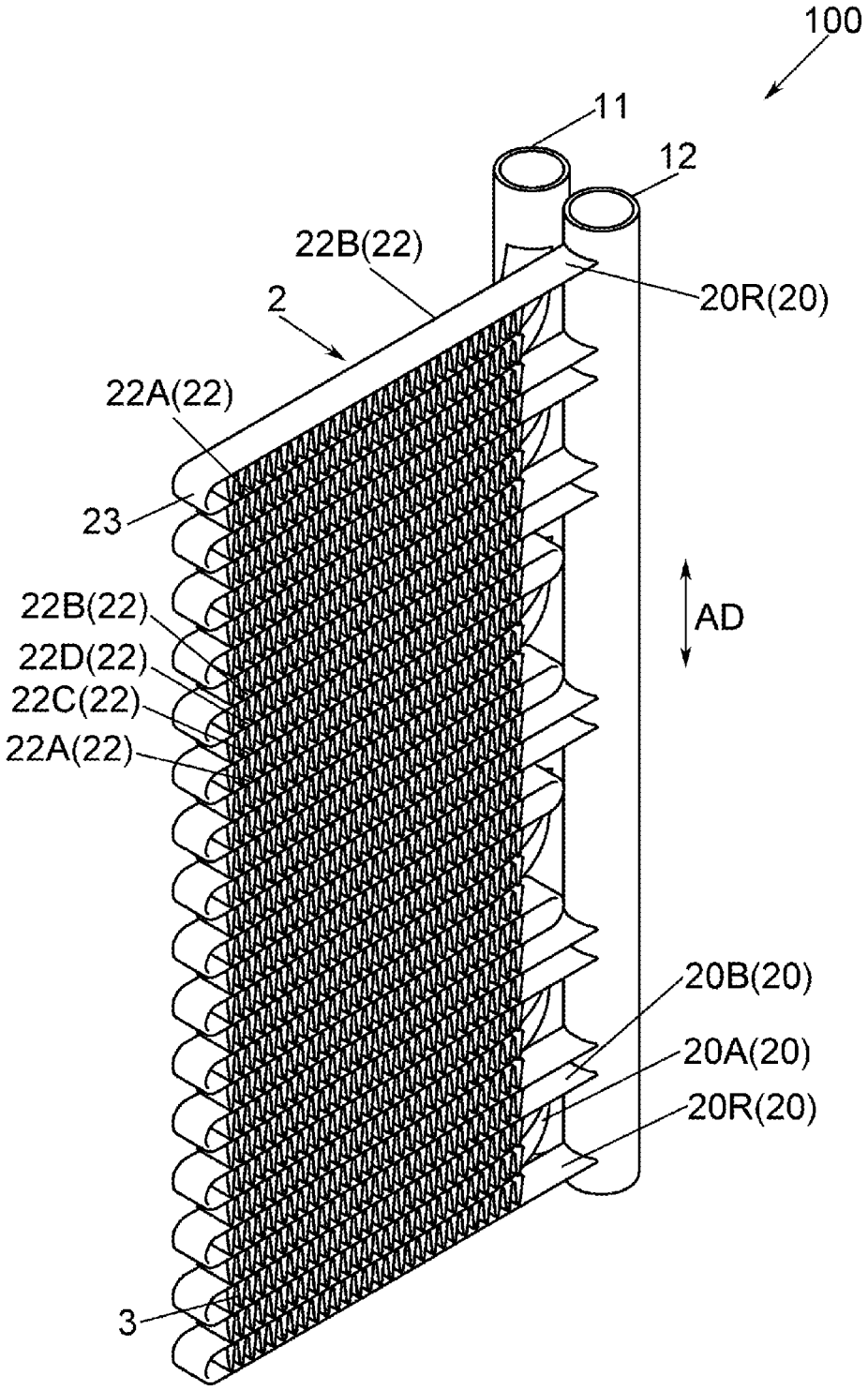
FIG. 4 is a schematic perspective view of a heat exchanger according to another embodiment of the present invention, viewed from one side.
Figure 5:
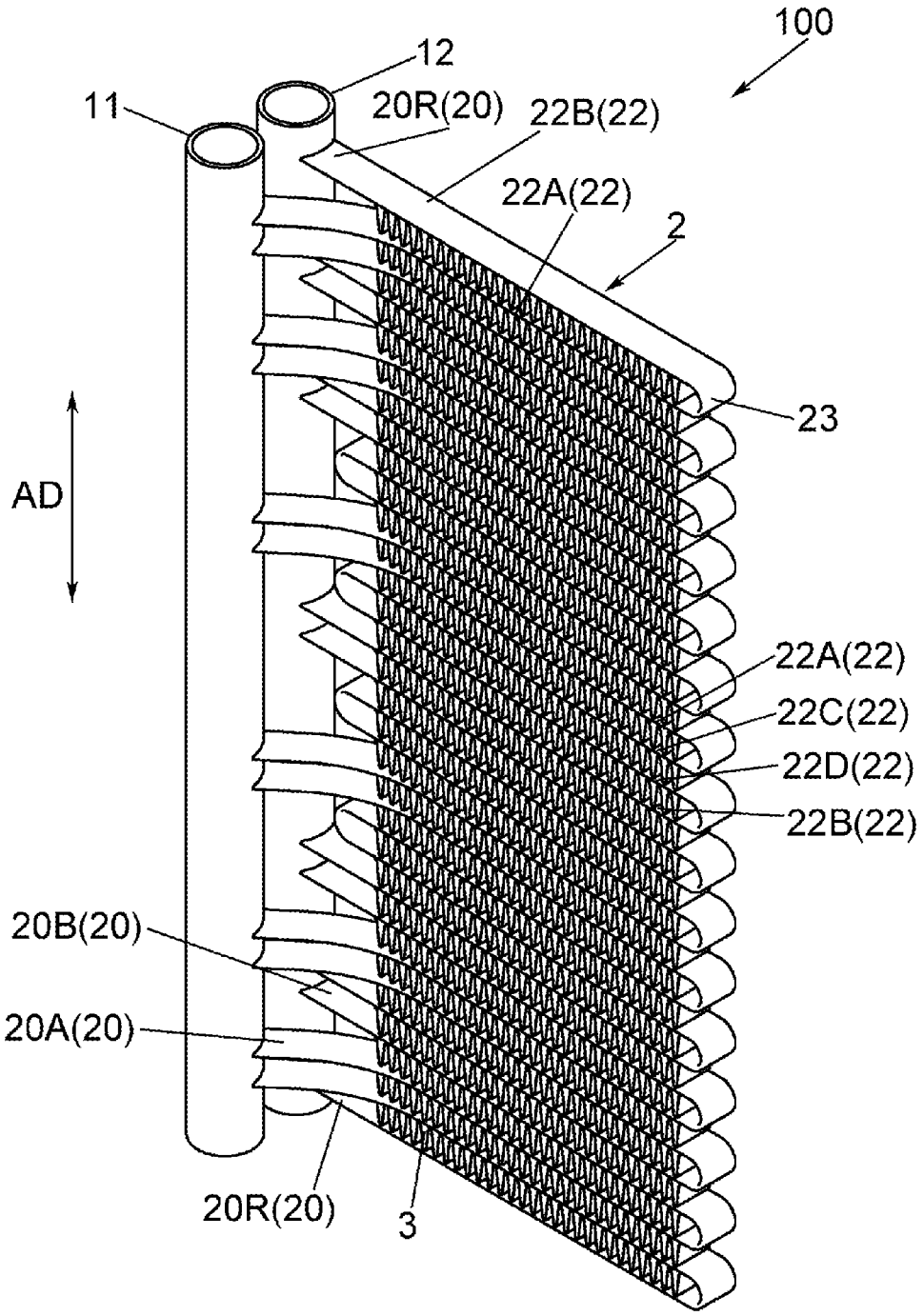
FIG. 5 is a schematic perspective view of the heat exchanger shown in FIG. 4, viewed from another side.

According to some embodiments of the present invention, referring to FIGS. 2-3, when viewed in a direction perpendicular to the plane in which the heat exchange parts 22 of the heat exchange tubes 2 lie, the heat exchanger 100 has a triangular or trapezoidal shape. The heat exchanger 100 is configured such that during use, the first manifold 11 and the second manifold 12 are arranged substantially horizontally.

Referring to FIGS. 2-3, in embodiments of the present invention, multiple heat exchange tubes 2 of different lengths may be separately disposed in the lengthwise direction AD of the first manifold 11 or second manifold 12 according to the dimensions of an installation space, so as to correspond to the shape of a wind passage surface, make full use of the installation space, reduce wind resistance, and increase the heat exchange efficiency. The total length of the heat exchange tube 2 is the sum of the lengths of the two ends 20, the multiple heat exchange parts 22 and the connecting part 23. In a direction perpendicular to the lengthwise direction AD of the first manifold 11 or second manifold 12, the heat exchange parts 22 (e.g. straight tube segments) of the heat exchange tubes 2 are longer in a region of larger spatial dimensions, and the heat exchange tubes 22 (e.g. straight tube segments) are shorter in a region of smaller installation space dimensions.

Referring to FIGS. 2-3, in an example of the present invention, in the case where the installation space is approximately triangular or trapezoidal, the first manifold 11 and second manifold 12 are horizontally disposed at the bottom of the installation space, and the height dimension of the installation space above the first manifold 11 and second manifold 12 increases and then decreases in the lengthwise direction AD of the first manifold 11 or second manifold 12. Multiple heat exchange tubes 2 of different lengths are disposed in the lengthwise direction AD of the first manifold 11 or second manifold 12 according to the dimensions of the installation space; the lengths of the heat exchange tubes 2 or the lengths of the heat exchange parts 22 increase from a minimum to a maximum, and then decrease from the maximum to the minimum, in the lengthwise direction AD of the first manifold 11 or second manifold 12. In this way, conformity with the shape of the installation space is achieved, full use is made of the installation space, wind resistance is reduced, and heat exchange efficiency is increased.

According to some embodiments of the present invention, referring to FIGS. 12-15, when viewed in the lengthwise direction AD of the first manifold 11 or second manifold 12, the multiple heat exchange parts 22 of each heat exchange tube 2 may have any suitable shape. For example, in addition to the heat exchange parts 22 having the linear shape mentioned above, the multiple heat exchange parts 22 of each heat exchange tube 2 may substantially have the V-shape shown in FIG. 12, the N-shape shown in FIG. 13, the L-shape shown in FIG. 14, or the shape shown in FIG. 15, formed by a non-closed line extending along a rectangle. Thus, the heat exchanger may have different shapes according to the dimensions of the installation space, so as to make full use of the installation space and increase the heat exchange efficiency.

The heat exchanger according to embodiments of the present invention can effectively reduce the thermal bridge effect between at least some of the heat exchange tubes, increasing the heat exchange flow path and improving the overall performance of the heat exchanger while utilizing the installation space rationally.

In the heat exchanger according to embodiments of the present invention, at least one pair of ends 20 connected to the same manifold are arranged adjacently, such that the temperature difference between the adjacent heat exchange tubes is small, effectively reducing the thermal bridge effect between the heat exchange tubes, and improving the heat exchange effect. In addition, the heat exchange tubes in a heat exchange region where the wind speed of wind passing through the heat exchanger 100 is greater have more heat exchange parts, effectively utilizing the heat exchange area and improving the heat exchange effect. Furthermore, the lengths of the heat exchange parts of each heat exchange tube are adjusted according to the installation space, so as to conform to the shape of the installation space, and different bending forms of the heat exchange tubes can suit different apparatus demands, such that the application environment of the heat exchanger can be broadened. The manifolds are disposed at the same side, simplifying the pipeline connections, and reducing the heat exchange area occupied by the manifolds.

Although the above embodiments have been described, the above embodiments and certain features in the above embodiments can be combined to form new embodiments.

What is claimed is:

1. A heat exchanger, comprising:

a first manifold and a second manifold disposed at one and the same side of the heat exchanger; and multiple heat exchange tubes, each heat exchange tube comprising:

two ends, the two ends respectively being a first end and a second end, the first end and the second end being respectively connected to and in fluid communication with the first manifold and the second manifold; and multiple heat exchange parts, the multiple heat exchange parts comprising a first heat exchange part and a second heat exchange part, the first heat exchange part and the second heat exchange part being respectively connected to and in fluid communication with the first end and the second end; in a lengthwise direction of the first manifold or the second manifold, the ends of the multiple heat exchange tubes comprising at least one pair of adjacently arranged first ends and/or at least one pair of adjacently arranged second ends;

wherein no other ends of the multiple heat exchange tubes are between the adjacently arranged ends.

2. The heat exchanger according to claim 1, wherein:

among the ends of the multiple heat exchange tubes, except for two outermost ends respectively located at two sides, the ends comprise at least one pair of adjacently arranged first ends and/or at least one pair of adjacently arranged second ends.

3. The heat exchanger according to claim 1, wherein:
the heat exchange parts of the multiple heat exchange tubes are substantially parallel.

4. The heat exchanger according to claim 1, wherein:
each heat exchange tube further comprises a connecting part connecting multiple heat exchange parts.

5. The heat exchanger according to claim 1, wherein:
in the lengthwise direction of the first manifold or the second manifold, among the ends of the multiple heat exchange tubes, except for two outermost ends respectively located at two sides, the other ends comprise a first end group and a second end group arranged alternately, the first end group consisting of two first ends, and the second end group consisting of two second ends.

6. The heat exchanger according to claim 1, wherein:
in the lengthwise direction of the first manifold or the second manifold, among the ends of the multiple heat exchange tubes, except for two outermost ends respectively located at two sides, the other ends consist of a first end group and a second end group arranged alternately, the first end group consisting of two first ends, and the second end group consisting of two second ends.

7. The heat exchanger according to claim 1, wherein:
in the lengthwise direction of the first manifold or the second manifold, within a first range of the heat exchanger, the multiple heat exchange parts of each heat exchange tube further comprise a third heat exchange part and a fourth heat exchange part, which are respectively connected to the first heat exchange part and the second heat exchange part.

8. The heat exchanger according to claim 7, wherein:
in the lengthwise direction of the first manifold or the second manifold, within a second range of the heat exchanger which is different from the first range, the multiple heat exchange parts of each heat exchange tube consist of the first heat exchange part and the second heat exchange part.

9. The heat exchanger according to claim 1, wherein:
in the lengthwise direction of the first manifold or the second manifold, the number of heat exchange parts of each heat exchange tube within a first range of the heat exchanger is greater than the number of heat exchange parts of each heat exchange tube within a second range of the heat exchanger which is different from the first range.

10. The heat exchanger according to claim 1, wherein:
in the lengthwise direction of the first manifold or the second manifold, supposing that the number of heat exchange tubes within a first range of the heat exchanger is NL, and the number of heat exchange tubes within a second range of the heat exchanger which is different from the first range is NS, then $3*NS \leq 2*NL$.

11. The heat exchanger according to claim 1, wherein:
in the lengthwise direction of the first manifold or the second manifold, among the ends of the multiple heat exchange tubes, except for two outermost ends respectively located at two sides, the other ends comprise a first end and a second end arranged alternately within a first range of the heat exchanger, and a first end group and a second end group arranged alternately within a second range of the heat exchanger which is different from the first range, the first end group consisting of two first ends, and the second end group consisting of two second ends.

12. The heat exchanger according to claim 8, wherein:
the heat exchanger is configured such that during use, the wind speed of wind passing through the first range of the heat exchanger is greater than the wind speed of wind passing through the second range of the heat exchanger.

13. The heat exchanger according to claim 8, wherein:
in the lengthwise direction of the first manifold or the second manifold, the first range of the heat exchanger is a middle part of the heat exchanger, and the second range of the heat exchanger is parts at two sides of the first range of the heat exchanger.

14. The heat exchanger according to claim 1, wherein:
when viewed in a direction perpendicular to a plane in which the heat exchange parts of the heat exchange tubes lie, the heat exchanger has a triangular or trapezoidal shape.

15. The heat exchanger according to claim 14, wherein:
the heat exchanger is configured such that during use, the first manifold and the second manifold are arranged substantially horizontally.

16. The heat exchanger according to claim 1, further comprising:
a fin, disposed between adjacent heat exchange parts.

17. The heat exchanger according to claim 1, wherein:
said one and the same side of the heat exchanger is one and the same side in the direction of extension of portions of the heat exchange parts, said portions being directly connected to the first end and the second end.

18. The heat exchanger according to claim 1, wherein:
each of the heat exchange tubes is a single-piece heat exchange tube.

19. The heat exchanger according to claim 1, wherein:
when viewed in the lengthwise direction of the first manifold or second manifold, the multiple heat exchange parts of each heat exchange tube substantially have a V-shape, an N-shape, an L-shape, or a shape formed by a non-closed line extending along a rectangle.

20. An air conditioning system, comprising:
the heat exchanger according to claim 1.

21. The heat exchanger according to claim 1, wherein the first heat exchange part and the second heat exchange part of each of the multiple heat exchange parts are arranged along the lengthwise direction of the first manifold or the second manifold.

* * * * *